United States Patent [19]

Keck

[11] 4,243,012

[45] Jan. 6, 1981

[54] APPARATUS FOR SEPARATING JOINED-BRICKS

[75] Inventor: Dieter Keck, Ibbenbüren, Fed. Rep. of Germany

[73] Assignee: C. Keller GmbH u. Co. KG, Ibbenbüren-Laggenbeck, Fed. Rep. of Germany

[21] Appl. No.: 36,266

[22] Filed: May 4, 1979

[30] Foreign Application Priority Data

May 8, 1978 [DE] Fed. Rep. of Germany ..... 2819991

[51] Int. Cl.[3] ..... B28D 1/32

[52] U.S. Cl. ..... 125/23 R; 225/99; 225/103

[58] Field of Search ..... 225/98, 99, 103; 125/23 R, 23 C

[56] References Cited

U.S. PATENT DOCUMENTS

| | | | |
|---|---|---|---|
| 600,856 | 3/1898 | Brinkman | 125/23 C |
| 3,904,096 | 9/1975 | Worthmann | 225/98 |

*Primary Examiner*—Harold D. Whitehead

*Attorney, Agent, or Firm*—Jordan and Hamburg

[57] ABSTRACT

Apparatus for separating joined-bricks includes a transport means for moving the joined-bricks and a separating means disposed along the transport means for separating the joined-bricks into two parts, the separating means including a pressure bar engageable with the joined-bricks and actuating means operatively connected to the pressure bar to effect actuation of the latter, the actuating means providing for synchronous movement of the pressure bar with the engaged joined-brick during the separation, whereby the joined-bricks are movable without interruption along the transport means during the separation.

13 Claims, 12 Drawing Figures

1
2
3
4
5
6
7
8
9
10
15
A
B
V
VI
VII

APPARATUS FOR SEPARATING JOINED-BRICKS

BACKGROUND OF THE INVENTION

Federal Republic of Germany DE-OS No. 2549047 describes an arrangement for the separation of both parts of joined-bricks where the vertical standing joined-bricks are guided towards a separating unit which is disposed between a feeding transport device and a transport device which transports them away. The separating device consists of a pressure roller rigidly connected to deflecting rolls of the aforementioned transport devices and which is movable up and down with the deflecting rolls. The separating device consists also of a buffer arranged between the deflecting rolls. During the separation process the pressure roll presses upon a part of the joined-brick and simultaneously leads the other part of the joined-brick towards the buffer which exerts a counter pressure so that, due to the resulting shearing effect, the two parts of the joined-brick separate from one another. The separated parts are transported away by the out-transporting transport device. This transport device consists of narrow conveyor belts which gradually diverge from each other and each accepts a part of the separated joined-brick and transports the separated parts at such distances that the connecting sections sheared off by the separation process drop down. A solid plate, bracing the separated parts is disposed in the area of the conveyor belts so that the parts do not tip off the conveyor belts.

A disadvantage of this known arrangement is that the joined-brick is stopped for a short while during the separation step because the pressure roller presses against the buffer, thereby interrupting the progress of the joined-brick. This has a deleterious influence upon the passage, thereby lowering the output of the device.

Only one definite shape of joined-bricks can pass through the separation device because the pressure roll is rigidly connected to the deflecting roll, thereby solidly and unchangeably fixing the distance between the edge, transport devices, and pressure roll. That is disadvantageous because brick manufacturing facilities always manufacture various shapes and sizes, and a device which can process one shape and size only is not practical.

This known device could only be used when a separate separation device for another shape were provided which could be substituted for the existing separation device. If that were done the known device would become very expensive, because a separate separation device would have to be provided for each shape.

Transportation of the separated parts of the joined-bricks in oblique positions upon the conveyor belts towards a storage area or packaging area is disadvantageous because the oblique position of the separated parts counter indicates the automation of the storage or packaging area.

OBJECTS AND ADVANTAGES

An objective of the present invention is to overcome the disadvantage of the aforesaid known devices and provide apparatus for the separation of both parts of joined-brick in such a manner that the splitting of the joined-brick occurs in a continuous passage without stopping during the separation, that joined-bricks of differing shapes and sizes may be processed without conversion of the plant, and that the separated and vertically standing parts can be tipped in a horizontal, face-up position in order to facilitate consecutive workstages, such as storage, stacking and/or packaging.

The separation process of the present invention is considerably shortened by the articulated support of the pressure bar which, synchronously with the joined-bricks, separates both parts of the joined-brick from each other. This saving of time is concomittant with an increase of output.

The mobility-in-height of the pressure bar makes it possible to provide for regulation for bricks of any arbitrary height. Thus, the separation apparatus can process joined-bricks of various shapes and sizes without necessitating a conversion due to change of shape or dimension.

The arrangement of conical wheels in the area of the converyor belts and the gradual increase of the taper of the conical wheels, arranged in tandem, guides the separated parts of the joined-bricks from the vertical position in a prone position where the flat face faces upwardly.

This flat position, for instance, allows a suction gripper to easily grasp the parts in order to deposit them upon further processing devices such as stackers and/or packaging devices.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

Figure 1:
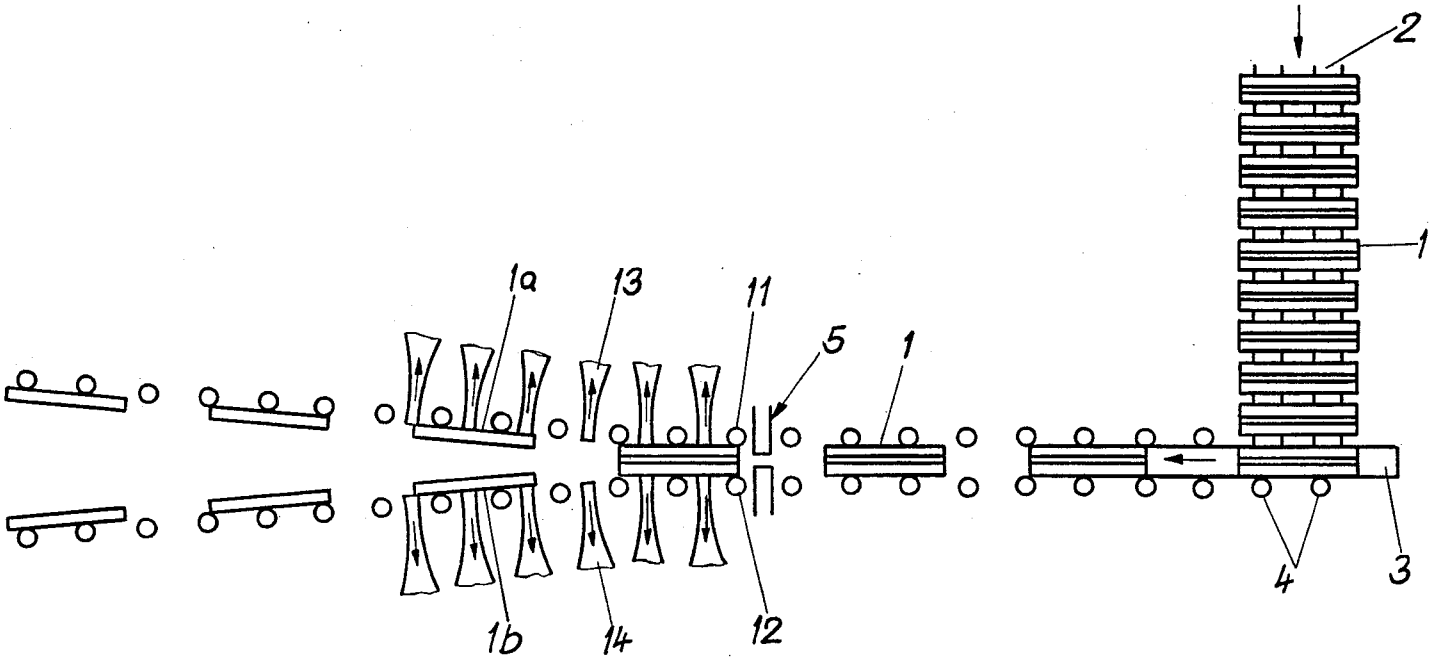
FIG. 1 is a schematic top plan view of a separation apparatus according to one embodiment of the invention.

FIGS. *7a, 7b,* and *7c* are partial views showing the progress of the joined-bricks passing the rolls.

DESCRIPTION OF THE PREFERRED EMBODIMENTS

Referring to the drawings, joined-bricks 1 are transferred by a two-part conveyor belt 2 to a conveyor belt 3 arranged at a right angle to the conveyor belt 2. The joined-bricks 1 are conveyed in an up-ended position wherein they are assisted by supporting rolls 4 arranged lateral to the conveyor belt 3 upon being transferred to the latter.

The conveyor belt 3 transports the joined-bricks 1 in the direction of a separation device 5 and transfers the split-bricks 1 for further transportation to a two-part roller track 6 leading through the area of the separating device 5. The two-part roller track 6 has rolls 6*a* supporting and transporting the part 1*a* of the joined-brick and rolls 6*b* supporting and transporting the other part 1*b* of the joined-brick 1.

Figures 2, 3:
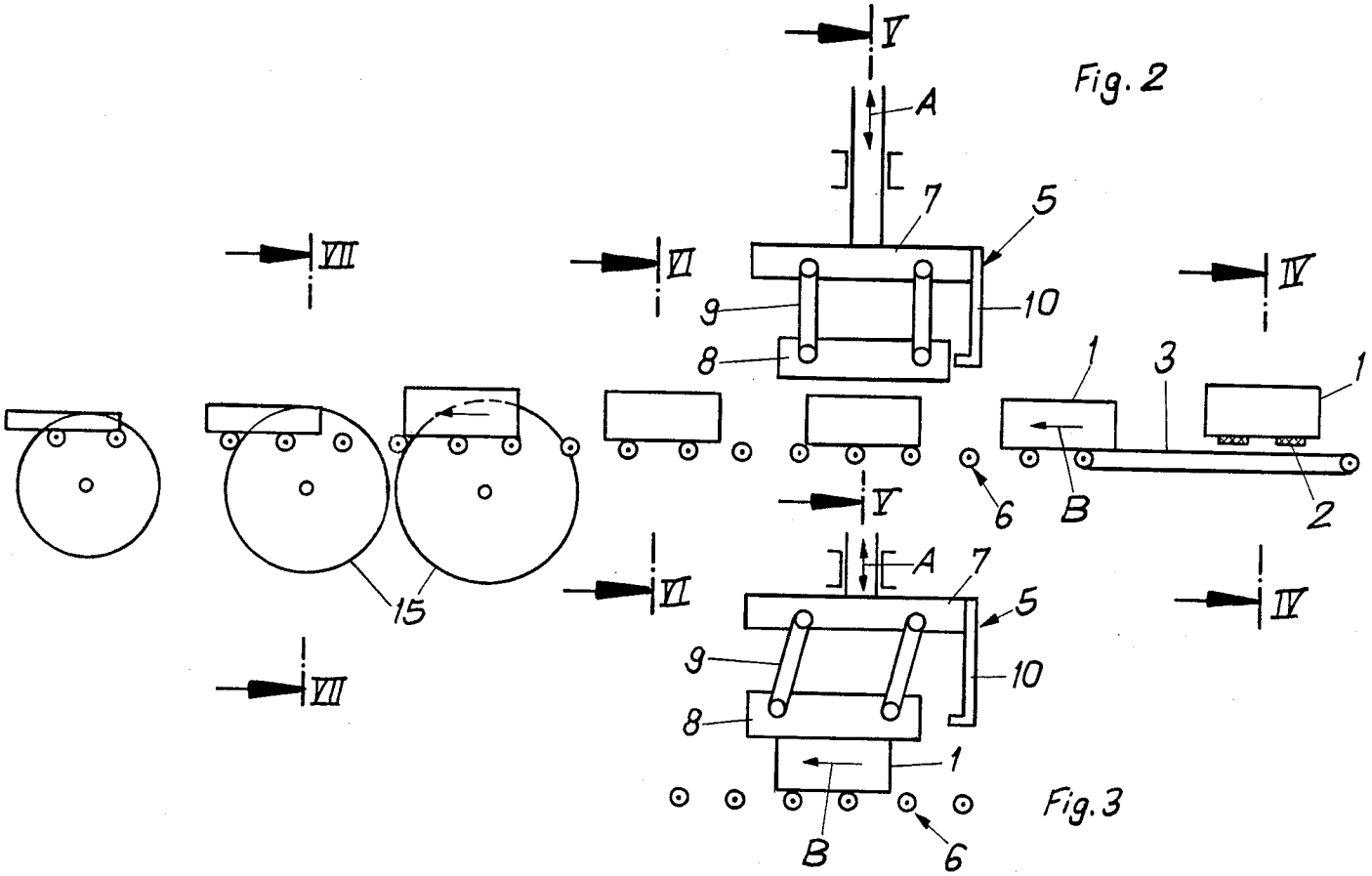
FIG. 2 is a side elevational view of the apparatus shown in FIG. 1.
FIG. 3 is a partial side elevational view of the separation apparatus in a working position.
Figure 2A:
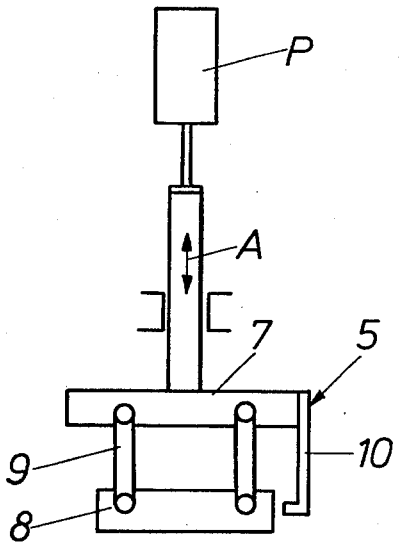
FIG. 2*a* is a partial side elevational view of the apparatus.
Figure 2B:
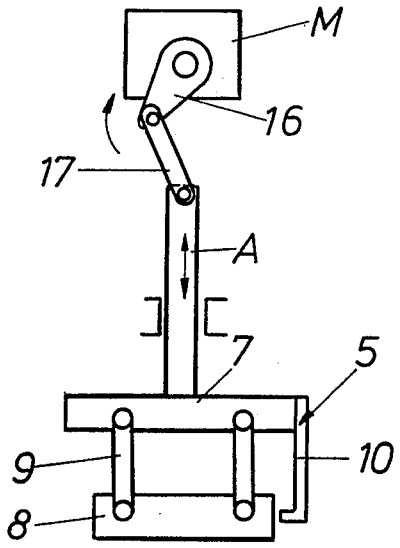
FIG. 2*b* is a partial side elevational view similar to FIG. 2*a* but showing an alternate embodiment.
Figure 4:
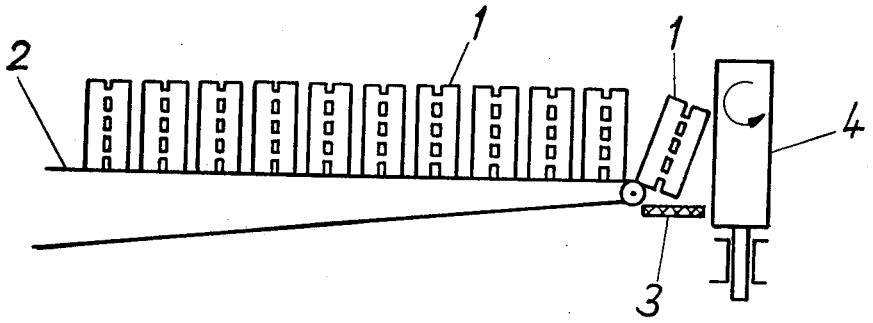
FIG. 4 is a cross sectional view taken along the line IV—IV in FIG. 2.
Figure 6:
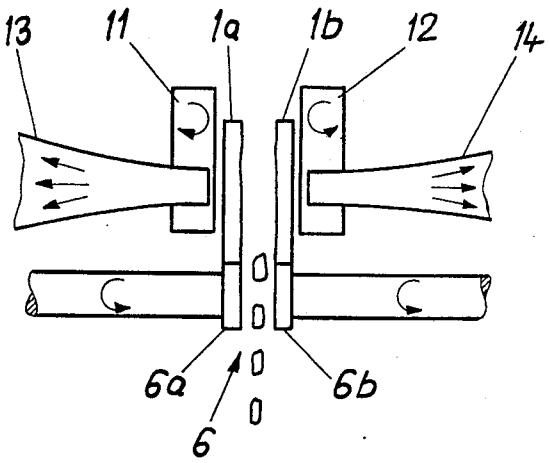
FIG. 6 is a cross sectional view taken along the line VI—VI in FIG. 2.
Figure 5:
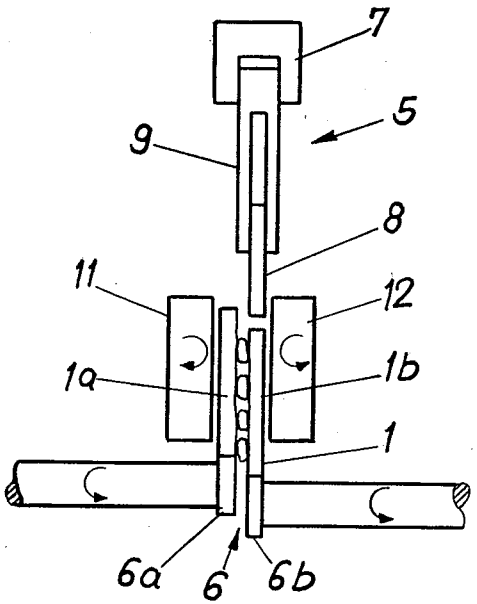
FIG. 5 is a cross sectional view taken along the line V—V in FIG. 2.

The separation device 5 consists of a carrier 7 and a pressure bar 8. The pressure bar 8 is articulatedly supported by the carrier 7 by means of pivotal links 9. A buffer or stop 10 fastened to the carrier 7 prevents the pressure bar 8 from moving beyond the buffer in a direction opposite to the movement of the joined-bricks 1. The separation device is movably vertically in the direction of the double arrow A as shown in FIG. 2. Suitable operable means are provided to effect such vertical movement. For example, a pneumatic cylinder P (FIG. 2*a*) or a motor M driving a crank arm 16 and link 17 may be used as shown in FIG. 2*b*.

In the area of the separation device 5, the rolls 6*b* of the roller track 6 are offset downwardly relative to the rolls 6*a* so that only the rolls 6*a* carry the part 1*a* of the joined-bricks 1 while a space is provided between the parts 1*b* and the rolls 6*b*.

During the separation process the separation device 5 moves vertically downwardly so the the pressure bar 8 engages the part 1*b* of the joined-brick. When the separation device 5 is further moved downwardly the pressure bar 8 exerts pressure upon the part 1*b* of the joined-brick 1 and moves it out of its hitherto existing position downwardly until it is received by the rolls 6*b* of the roller track 6.

Due to the fact that the part 1*a* of the joined-brick 1 is supported during this process by the rolls 6*a* of the roller track 6 and remains at its place, the separation of the parts 1*a* and 1*b* occurs due to the shearing effect between the parts 1*a* and 1*b* causing the rupture of the connecting sections which hold the parts 1*a* and 1*b* together. Because the pressure bar 8 is connected by the articulated levers 9 to the carrier 7, the pressure bar 8 moves in unison or synchronously with the joined-brick 1 in the direction of the arrow B (FIG. 2) when touching down upon part 1*b* of the joined-brick 1 so that the separation of the joined-brick 1 occurs in a synchronized manner without stopping the advancement of the joined-brick 1. During the separation process and also later on the parts 1*a* and 1*b* are supported by vertically disposed supporting rolls 11 and 12.

Because the separated connecting sections still lie between the parts 1*a* and 1*b* and must be disposed off, the rolls 6*a* and 6*b* of the roller track 6 are arranged in a diverging manner such that the connecting sections are capable of falling downwardly. In order to prevent the parts 1*a* and 1*b* from moving inwardly due to the now larger interspace, horizontal suction nozzles 13 and 14 are arranged on a stretch of the diverging roller track 6 between the supporting rollers 11 and 12. The nozzles 13 and 14 hold the parts 1*a* and 1*b* against the supporting rollers 11 and 12, thereby maintaining them vertical.

Figure 7:
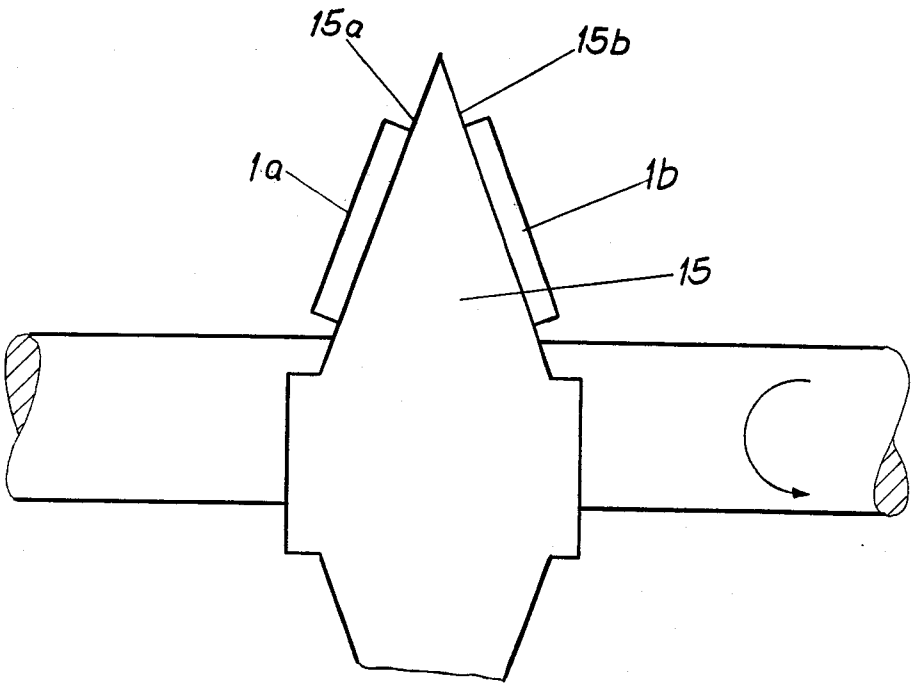
FIG. 7 is a cross sectional view taken along the line VII—VII in FIG. 2.
Figure 7A:
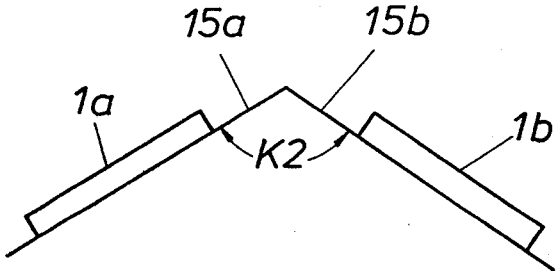
Figure 7B:
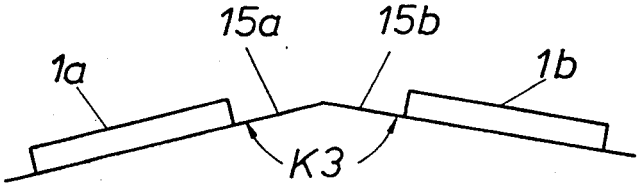
Figure 7C:
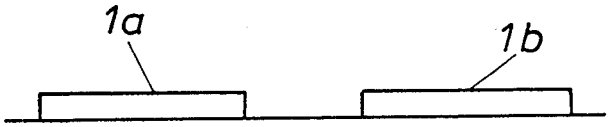

Once the distance between the rolls 6*a* and 6*b* of the roller track 6 has increased sufficiently, conical wheels 15 engage between the rolls 6*a* and 6*b*. The sides 15*a* and 15*b* of the conical wheels 15 engage the parts 1*a* and 1*b* after the supporting rollers 11 and 12 and the suction nozzles 13 and 14 have transferred their supporting function to the conical wheels 15 with their narrower sides facing upwardly in the extent of their taper and change after a certain distance into normal horizontally disposed rolls, arranged one above the other (not shown), so that the parts 1*a* and 1*b* are moved along with their flat sides face up. FIGS. 7*a* and 7*b* illustrate the increasing cone angle K2 and K3 of the sides 15*a*, 15*b* of the successive conical wheels, while FIG. 7*b* shows how the parts 1*a* and 1*b* are eventually disposed with their flat sides horizontally disposed.

I claim:

1. Apparatus for separating joined-bricks comprising a transport means for moving said joined-bricks, a separating means disposed along said transport means for separating said joined-bricks into two parts, said separating means comprising a vertically movable carrier means carrying a pressure bar, said vertically movable carrier means being disposed to cause said pressure bar to engage one part of said joined-brick to effect vertical movement thereof relative to another part of said joined-brick such that the joined-bricks are thereby separated, said carrier means comprising a vertically movable actuating means and pivotal means pivotally connecting said pressure bar to said actuating means such that when said pressure bar engages said one part of said joined-brick to effect said separation, said pressure bar moves synchronously with said engaged one part along said transport means as said pivotal means pivot, whereby the joined-bricks are movable without interruption along said transport means during said separation.

2. Apparatus according to claim 1 wherein said pivotal means comprises pivotal links pivotally connected between said actuating means and said pressure bar.

3. Apparatus according to claim 1 wherein said pressure bar moves laterally relative to the direction of vertical movement of said movable carrier means during said separation, said actuating means comprising a buffer to limit said lateral movement of said pressure bar.

4. Apparatus according to claim 3 wherein said buffer is disposed to limit the movement of said pressure bar in a direction from which the joined-bricks are being transported by said transport means.

5. Apparatus according to claim 3 wherein said actuating means comprises an elongated element which is reciprocal along a fixed vertical axis.

6. Apparatus according to claim 1 wherein said transport means comprises conveyor supports underlying said separating means, one of said conveyor supports engaging said other part of said joined-brick at one elevation, another of said conveyor supports being at a lower elevation such that during said separation, said one part of said joined-brick is forced downwardly by said pressure bar onto said lower conveyor support.

7. Apparatus according to claim 6 wherein said one conveyor support and said other conveyor support are disposed transversely of the direction of travel of said joined-bricks along said transport means such that said one conveyor support underlies said other part of said joined-brick and said other conveyor support underlies said one part of the joined-brick.

8. Apparatus according to claim 1 further comprising support means along said transport means for supporting said joined-bricks in an upright disposition as they are transported by said transport means.

9. Apparatus according to claim 8 wherein said support means comprises supporting rollers.

10. Apparatus according to claim 9 wherein said support means further comprise air suction nozzles disposed between said support rollers.

11. Apparatus according to claim 1 wherein said transport means comprises two diverging conveyor sections disposed downstream of said separating means, one of said diverging sections transporting said one part of said separated joined-brick and the other of said diverging sections transporting said other part.

12. Apparatus according to claim 11 further comprising conical wheels disposed along said transport means and engaging said separated first and second parts to orient the latter from an upright to a flat disposition.

13. Apparatus according to claim 12 wherein there are a plurality of said conical wheels wherein the conical wheels which are further upstream have smaller conical angles.

* * * * *